United States Patent [19]

Martin et al.

[11] Patent Number: 4,890,792

[45] Date of Patent: Jan. 2, 1990

[54] NOZZLE ASSEMBLY

[75] Inventors: Douglas S. Martin, Forest City, N.C.; Joseph W. J. Maas, Someren, Netherlands

[73] Assignee: AFA Products Inc., Forest City, N.C.

[21] Appl. No.: 181,143

[22] Filed: Apr. 13, 1988

Related U.S. Application Data

[63] Continuation-in-part of Ser. No. 158,329, Feb. 19, 1988.

[51] Int. Cl.[4] ..... B05B 7/30

[52] U.S. Cl. ..... 239/343; 239/120; 239/428.5; 239/478; 239/538

[58] Field of Search ..... 239/120, 289, 333, 343, 239/390, 391, 392, 394, 396, 478, 428.5, 538

[56] References Cited

U.S. PATENT DOCUMENTS

| | | | |
|---|---|---|---|
| 3,112,883 | 12/1963 | Blanchard | 239/394 |
| 3,843,030 | 10/1974 | Miacallef | 222/239 |
| 3,967,765 | 7/1976 | Miacallef | 222/554 |
| 4,141,504 | 2/1979 | Anderson | 239/396 |
| 4,234,128 | 11/1980 | Quinn et al. | 239/478 |
| 4,247,048 | 1/1981 | Hayes | 239/333 |
| 4,350,298 | 9/1982 | Tada | 239/343 |
| 4,463,905 | 8/1984 | Stoesser et al. | 239/428.5 |
| 4,598,862 | 7/1986 | Rice | 239/343 |
| 4,706,888 | 11/1987 | Dobbs | 239/478 |
| 4,717,074 | 1/1988 | Karliner et al. | 239/394 |
| 4,720,046 | 1/1988 | Morane | 239/343 |
| 4,730,775 | 3/1988 | Maas | 239/391 |
| 4,767,060 | 8/1988 | Shay et al. | 239/428.5 |
| 4,768,717 | 9/1988 | Shay | 239/428.5 |
| 4,779,803 | 10/1988 | Corsette | 239/428.5 |

*Primary Examiner*—Andres Kashnikow
*Assistant Examiner*—Michael J. Forman
*Attorney, Agent, or Firm*—Thomas R. Vigil

[57] ABSTRACT

The nozzle assembly comprises a cap and a bushing for mounting to the front of the body of a trigger sprayer in communication with a passage in the trigger sprayer. The cap is mounted to said bushing and is rotatable on the bushing between three positions, they being a stop position, a spray position and a foam position. The nozzle has first passage means and the cap has second passage means. The respective first and second passage means are arranged to communicate with each other in the rotated spray position and in the rotated foam position of the cap. The cap is provided with foam generating means within the cap and in communication with the respective passage means when the cap is rotated to a foam position for generating foam on actuation of a trigger of the trigger sprayer to which the nozzle assembly is mounted.

15 Claims, 4 Drawing Sheets

FIG. 1
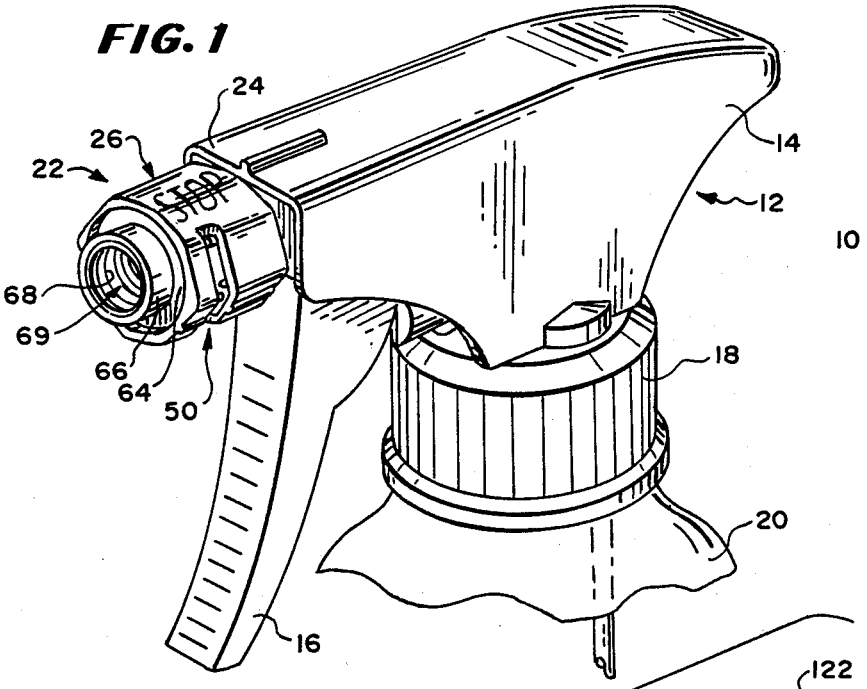
FIG. 2A
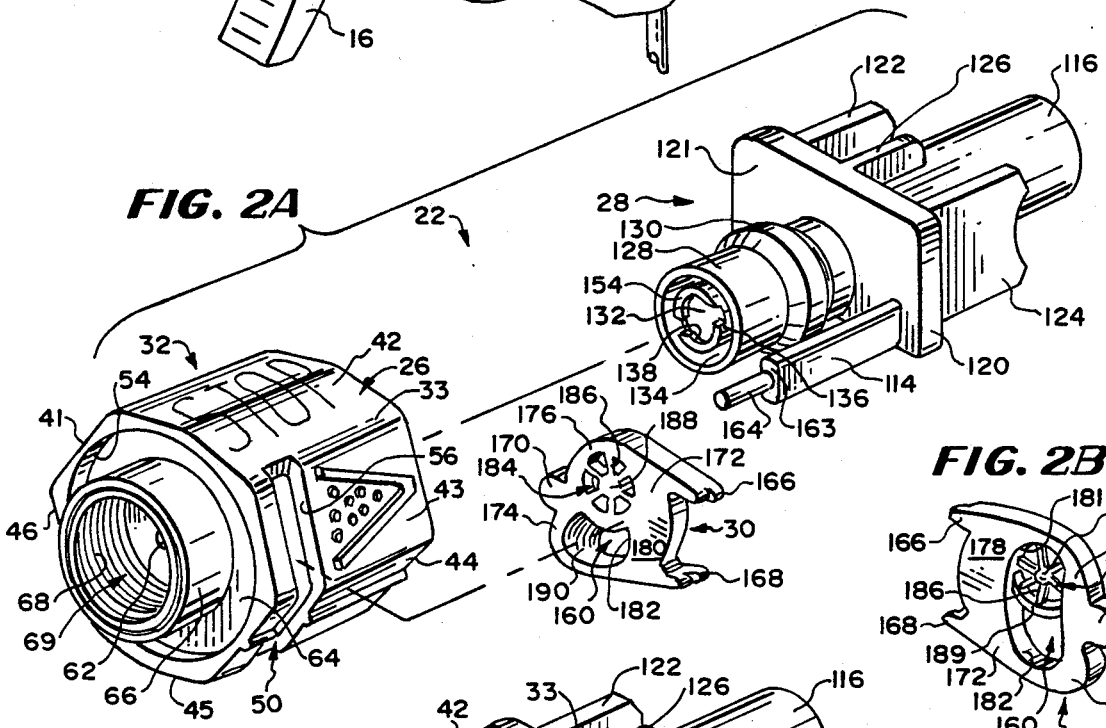
FIG. 2B
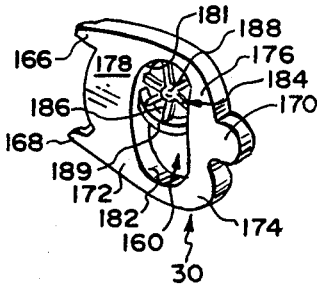
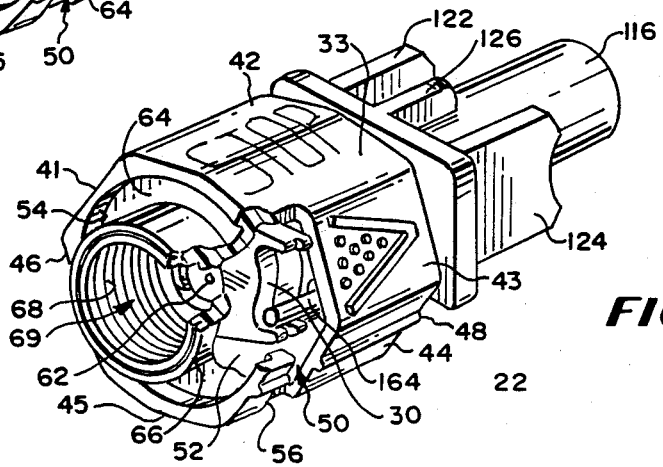
FIG. 3

NOZZLE ASSEMBLY

BACKGROUND OF THE INVENTION

1. Field of the Invention

The present invention relates to a three position nozzle assembly for mounting to the front end of the body of a trigger sprayer and in communication with a passageway in the trigger sprayer. More specifically, the present invention relates to a nozzle assembly which has a rotatable cap mounted on a bushing connected to the body of the trigger sprayer which cap is rotatable between three positions, a stop position, a spray position and a foam position and wherein the cap has a foam generating chamber which is utilized when the cap is rotated to the foam position and an element in the cap which is also moved into a foam generating position when the cap is rotated so that foam is generated and dispensed from the nozzle assembly instead of a spray.

2. Description of the Prior Art

Heretofore various foam generating nozzle assemblies have been proposed.

Some examples of these previously proposed foam generating nozzle assemblies are disclosed in the following patents:

| U.S. Pat. No. | Patentee |
|---|---|
| 4,350,298 | Tada |
| 4,463,905 | Stoesser et al |

In the Tada U.S. Pat. No. 4,350,298, a cap of a nozzle assembly is moved outwardly to establish a foam position of the assembly from an off position. The nozzle assembly disclosed in this patent only has two positions, namely a foam position or an off position and does not have a spray position. In one embodiment, the cap is rotated about a threaded member to move the cap outwardly from the off position of the nozzle assembly.

The Stoesser et al U.S. Pat. No. 4,463,905 discloses a nozzle assembly including a screen mounted on a hinged panel at the front of a trigger sprayer. The hinged panel can be moved upwardly to place the assembly in a spray position and can be moved downwardly to place the nozzle assembly in a foam position.

In the Maas copending application Ser. No. 158,329, there is disclosed a foam generating assembly which has an outer piece and an inner piece with the outer piece removably or releasably fixed to the inner piece. When the outer piece is connected to the inner piece the nozzle assembly can be rotated between a foam position and an off position. When the outer piece is removed from the inner piece, if they are not fixed together such as by spin welding, the inner piece can be rotated between an off position and a spray position. A parent application issued to U.S. Pat. No. 4,730,775.

In the foam position of the Maas nozzle assembly an air passageway opens at the front end of the nozzle assembly beneath a foam dispensing chamber of the nozzle assembly and extends rearwardly into the nozzle assembly to a chamber at the entrance to a foam generating chamber whereby air enters into the foam generating chamber with liquid being ejected from an orifice for mixing of the liquid with air in the foam generating chamber to form foam. At the same time, foam dripping from the foam dispensing chamber is sucked into the air passageway back to the entrance to the foam generating chamber. This air passageway concept is carried forward in this continuation-in-part application. In other respects, the structure of the nozzle assembly disclosed herein is significantly different from the prior Maas nozzle assembly.

As will be described in greater detail hereinafter, the only movement required of the nozzle assembly of the present invention is rotation of a cap of the nozzle assembly between a stop position, a spray position and a foam position. No parts have to be lifted or moved outwardly from another part. As a result, the nozzle assembly of the present invention is easy to use, provides three positions, and comprises a minimum number of injection molded plastic parts which minimize the cost of the nozzle assembly.

SUMMARY OF THE INVENTION

A nozzle assembly for mounting to a trigger sprayer having a body with a front portion and a passage therein and a trigger mounted thereto, said nozzle assembly comprising: a cap, a bushing for mounting to a front portion of a body of a trigger sprayer in communication with a passage in the trigger sprayer; said bushing having first passage means for communicating the passage in the body with said cap and said cap having second passage means for communicating with said first passage means in said bushing, being mounted to and on said bushing and being rotatable on said bushing between three positions, they being a stop position where the first passage means does not communicate with the second passage means, a spray position where said first passage means is in communication with said second passage means and a foam generating position where said first passage means is in communication with said second passage means, said respective first and second passage means of said bushing and said cap being arranged to communicate with each other in the rotated spray position and in the rotated foam generating position of the nozzle assembly, and foam generating means mounted within said cap and arranged to be moved into communication with said second passage means when said cap has been rotated to said foam generating position for generating foam on actuation of a trigger of the trigger sprayer to which the nozzle assembly is mounted.

BRIEF DESCRIPTION OF THE DRAWINGS

FIG. 1 is a perspective view of a trigger sprayer having mounted thereon the nozzle assembly of the present invention.

FIG. 2A is an exploded perspective view of the nozzle assembly of the present invention which is mounted to the front end of the trigger sprayer shown in FIG. 1.

FIG. 2B is a perspective view of the nozzle shuttle viewing same from the back side thereof.

FIG. 3 a perspective view of the nozzle assembly detached from the trigger sprayer shown in FIG. 1 with portions broken away to show the position of parts of the nozzle assembly within a nozzle cap of the assembly.

DESCRIPTION OF THE PREFERRED EMBODIMENT(S)

Figure 4:
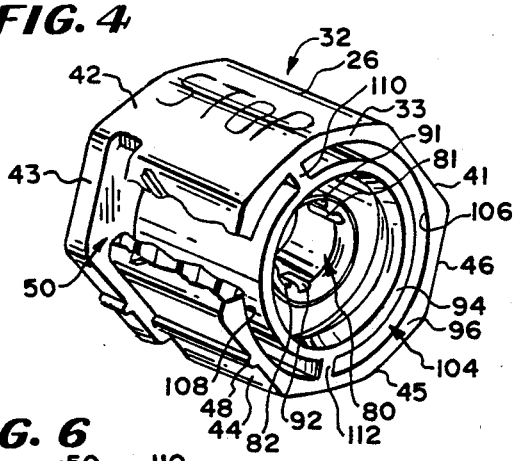
FIG. 4 is a perspective view with portions broken away of the nozzle cap viewing same from the back side thereof.

Referring now to the drawings in greater detail, there is illustrated in FIG. 1 a trigger sprayer 10 which can be of the type disclosed and claimed in U.S. Pat. No. 4,669,664. The trigger sprayer 10 includes a body 12, comprising a shroud 14, a trigger 16 pivotably mounted to the body 12 and a cap 18 for securing the body 12 to a container 20. The trigger sprayer 10 also includes a nozzle assembly 22 which is connected to a front end 24 of the body 12 of the trigger sprayer 10 and which is constructed according to the teachings of the present invention.

The nozzle assembly 22 is shown with the parts thereof in an exploded perspective view in FIG. 2A and comprises a nozzle cap 26 (simply cap 26), a nozzle bushing 28 (simply bushing 28) which is mounted to the front end 24 of the trigger sprayer body 12, and a nozzle shuttle 30 (simply shuttle 30) which is received in the cap 26 and cooperates with the cap 26 and the bushing 28 for effecting three modes or positions of operation of the nozzle assembly 22.

Figure 5:
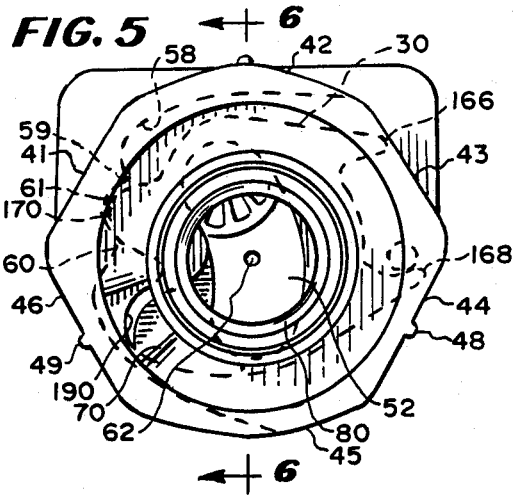
FIG. 5 is a front plan view of the nozzle assembly shown in FIG. 3 with the nozzle cap and a nozzle shuttle in one position of the nozzle assembly.
Figure 6:
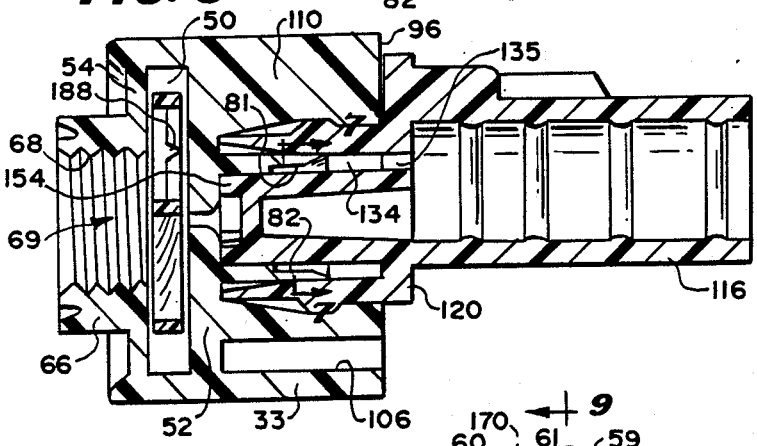
FIG. 6 is a longitudinal cross-sectional view of the nozzle assembly shown in FIG. 5 and is taken along line 6—6 of FIG. 5.
Figure 7:
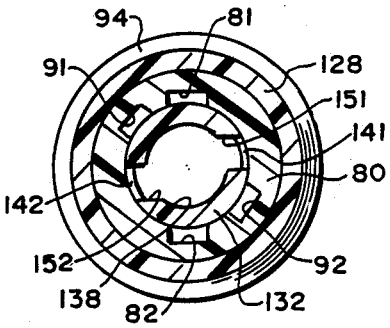
FIG. 7 is a sectional view taken along line 7—7 of FIG. 6 and shows the alignment of certain passages in the nozzle cap and in a nozzle bushing of the nozzle assembly in one relative position between the cap and the bushing.

One position is an Off position shown in FIGS. 5, 6 and 7. Another position is a spray position shown in FIGS. 8, 9 and 10. A third position is a foam position shown in FIGS. 11, 12, 13 and 14. These positions will be described in greater detail hereinafter in connection with the description of the respective figures.

As shown in FIGS. 2A and 4, the cap 26 includes a main body portion 32 including a peripheral outer wall 33 having six sides 41–46 including a spray side 41, a stop side 42, and a foam side 43. When any one of these three sides is in an upper horizontal position, such as the stop side 42 shown in FIGS. 2A and 3, the cap 26 is in the position to effect the function indicated. Thus in FIGS. 2A and 3, the cap 26 is in the stop position where no liquid can be ejected from the nozzle assembly 22.

The hex or six sided shape of the body 32 of the cap 26 serves another function in that it facilitates gripping of the cap 26 for rotating the cap 26 relative to the bushing 28 between the three positions thereof. Further to assist in the gripping of the cap 26, two other sides 44 and 46 have ribs 48 and 49.

Although hidden from view, it is to be understood that the spray side 41 has a V thereon with dashes extending from the apex of the V to indicate "spray" and the side 43 has a V with dots therein as shown in FIGS. 2A and 3 to indicate foam. The side 42 has the word "STOP" thereon in raised letters.

The body 32 has a transverse slot 50 which extends into and across the body 32 between a rear wall 52 and a forward wall 54. The slot 50 has an entry portion 56 extending through sides 43, 44 and an internal curved end wall 58 extending from side 42 beneath sides 41, 46 and 45 to side 44. The end wall 58 of slot 50 is shown in phantom in FIGS. 5, 8 and 11 and includes two hills 59 and 60 forming a notch 61 therebetween.

The center of the forward wall 54 has an orifice 62 therein through which liquid is emitted or ejected in a conical spray when the cap 26 is in either the spray position (FIG. 8) or the foam position (FIG. 10) and the trigger 16 of the sprayer 10 is actuated.

Extending from a front side 64 is a foaming cylinder 66 having an irregular, namely threaded, inner surface 68.

It is to be understood that the shuttle 30 is received in the slot 50 between the rear wall 52 and the forward wall 54 and as shown in FIG. 6, a foaming chamber 69 is defined within the threaded inner surface 68 of the foaming cylinder 66 forwardly of the forward wall 54. Between the side 46 and the foaming cylinder 66 there is provided a wedge shaped slot 70 through the forward wall 54 from the front side 64 to the slot 50.

As shown in FIGS. 4 and 5, extending rearwardly from the rear wall 52 is a short cylinder 80 surrounding the orifice 62. The inner surface of the short cylinder 80 has a first pair of slots 81 and 82 radially opposed from each other and a second pair of slots 91 and 92, angularly offset about the short cylinder 80, and radially opposed from each other, as also shown in FIG. 7. A longitudinal cross section of the pair of slots 81 and 82 is shown in FIG. 6.

Radially outwardly from the short cylinder 80 is a second cylinder 94 which extends to a backside 96 of the cap 26.

Figure 12:
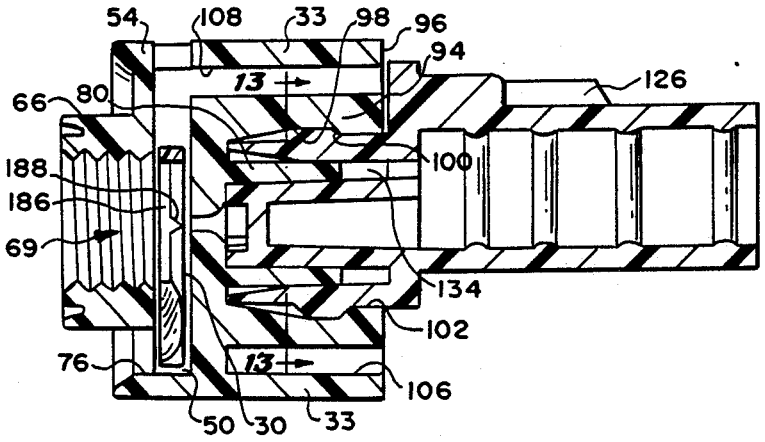
FIG. 12 is a longitudinal sectional view of the nozzle assembly taken along line 12—12 of FIG. 11.
Figure 15:
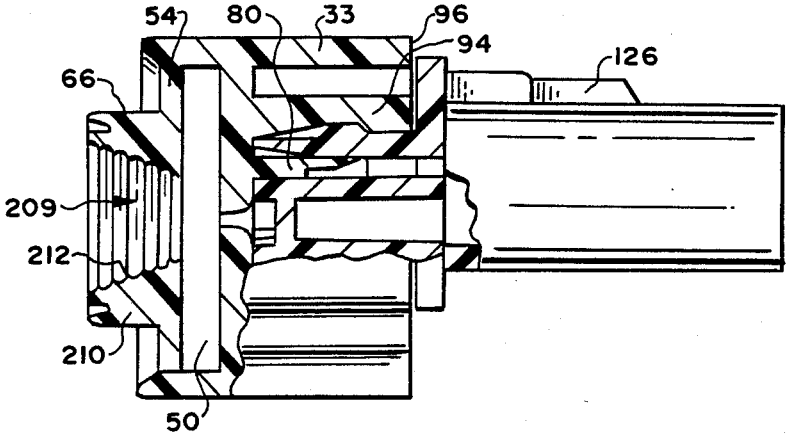
FIG. 15 is a side plan view of a modified nozzle assembly with portions broken away to show a cross section of a portion of the nozzle assembly as shown in FIG. 11 and shows the cap with a modified foaming chamber.

As shown in FIG. 12, the inner surface 98 of this second cylinder 94 tapers rearwardly and radially outwardly to a larger diameter area and then inwardly to form a shoulder 100 and finally longitudinally at 102 to the backside 96 of the cap 26. This larger diameter area just forward of the shoulder 100 provides for a snap fitting of the cap 26 onto the bushing 28 as will be explained in greater detail hereinafter.

As shown in FIG. 4, a space 104 is provided between the second cylinder 94 and the outer peripheral wall 33 of the cap 26. This space 104 is broken into two portions 106 and 108. One portion 106 extends to the rear wall 52 and the other portion 108 extends through the rear wall 52 to communicate with the transverse slot 50. This second space portion 108 extends between a first radial wall 110 and a second radial wall 112 defining the second space portion 108 therebetween such that the space portion 108 forms a partially annular slot which receives a post 114 extending from the bushing 28 which will now be described in detail.

Turning now to FIGS. 2A and 6, it will be appreciated that the bushing 28 includes a rearwardly extending tubular portion 116 which is adapted to extend over a cylindrical boss (not shown) in the body 12 of the trigger sprayer 10. The inner surface of the tubular portion 116 has ribs 118 therein for facilitating engagement with annular grooves in the cylindrical boss in the body 12 of the sprayer 10, hidden from view in FIG. 1.

Extending transversely at the front end of the tubular portion 116 is a plate portion 120 which forms a front face of the trigger sprayer 10 when the bushing 18 is mounted to the trigger sprayer body 12.

The plate portion 120 has two rearwardly extending locating arms 122 and 124 which are received within the shroud or cowling 14 of the body 12 of the trigger sprayer 10. Also, a short rib 126 extends rearwardly from the plate portion 120 integral with the tubular portion 116.

Extending forwardly from the plate portion 120 is a cylindrical portion 128 which has an annular rib 130 thereon and which is adapted to be received within the second cylinder 94 of the cap 26 between the short cylinder 80 and the second cylinder 94. The rib 130 is adapted to be snap fittingly received in the larger diameter area just forward of the shoulder 100 and engages the shoulder 100 to look the cap 26 to the cylindrical portion 128.

Within the cylinder portion 128 and also extending outwardly from the plate portion 120 is a cylindrical boss 132 of smaller diameter such that there is an annular space 134 formed between the cylindrical boss 132 and the cylindrical portion 128. This annular space 134 extends all the way back to the plate portion 120 and the plate portion 120 has a slot 135 therethrough adjacent the top side of the cylindrical boss 132 between the cylindrical boss 132 and the cylindrical portion 128 communicating the annular space 134 with the interior of the rearwardly extending tubular portion 116.

As shown in FIG. 2A, a front end 136 of the cylindrical boss 132 has a cylindrical cavity 138 therein. A pair of longitudinally extending side slots 141, 142 formed in the outer periphery of the cylindrical boss 132 and a pair of transverse slots 151, 152 are formed in the front end 136 of the boss 132 in alignment with the side slots 11, 142 and in communication with the cavity 138. These slots 151, 152 are cut through a wall 154 of the cavity 138 so as to communicate with the cavity 138 on a tangent, rather than on a radius.

Figure 9:
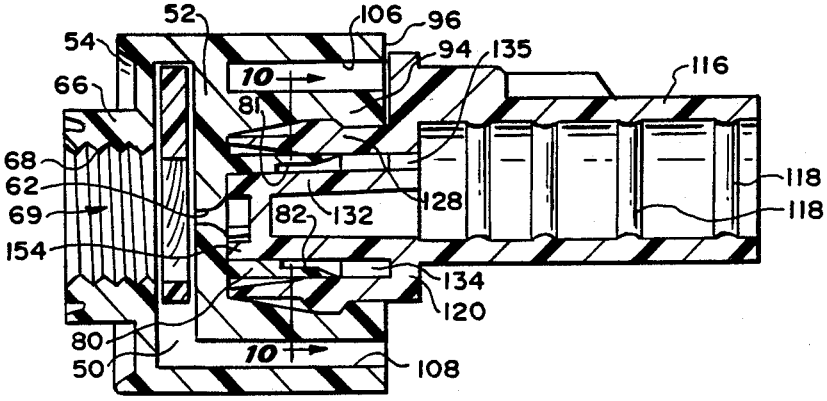
FIG. 9 is a longitudinal sectional view of the nozzle assembly shown in FIG. 8 and is taken along line 9—9 of FIG. 8.

As is well known in the art of trigger sprayers, this configuration allows liquid that flows through the tubular portion 116, the slot 135 in the plate portion 120, and the annular space 134 to the side slots 141, 142 and then through the tangential transverse slots 151, 152 to enter the cavity 138 on a tangent such that the liquid is caused to swirl in the cavity 138 and then exit forwardly therefrom through the orifice 62 in the rear wall 52 in the cap 26 to create a conical spray shown by dashed lines in FIG. 9. Such a formation at the front end 136 of a cylindrical boss 132 is often referred to as a spin or spray element.

Figure 14:
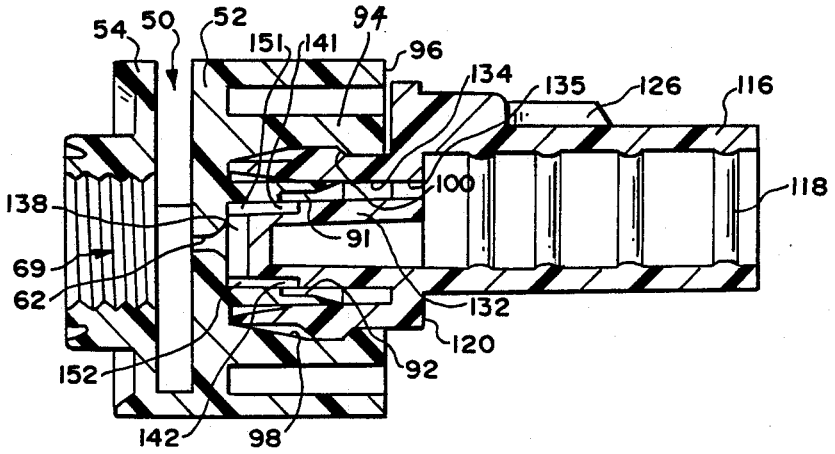
FIG. 14 is a longitudinal sectional view of the nozzle assembly shown in FIG. 11 and is taken along line 14—14 of FIG. 11.

With reference to FIG. 14, it will be appreciated that when the side slots 151, 152 leading to the tangential transverse slots 141, 142 communicating with the cavity 138 in the cylindrical boss 132 are in communication with one of the pair of the slots 81, 82 or 91, 92 the tubular portion 116 is in communication with the orifice 62. In FIG. 9 the pair of slots 81 and 82 are in communication with the side slots 151, 152 and liquid flows from the tubular portion 116 through the slot 135 in the plate portion 120 through the annular space 134 through the slots 81, 82 in the short cylinder 80, through the side slots 151, 152 on the boss 132 and then through the tangential transverse slots 141, 142 into the cavity 138 and from the cavity 138, out through the orifice 62 in the rear wall 52 in the cap 26 and against and through the shuttle 30. In FIG. 14 when slots 141, 142 are in registry with the slots 91, 92 the orifice 62 directs liquid through a portion of a bean shaped slot 160 in the shuttle 30 as will be described in greater detail hereinafter.

The post 114 from bushing 28 extends outwardly from a front face 162 of the plate portion 120 and has a rectangular-in-cross-section body 163 except at the outer distal end thereof where the post 114 has a pin 164 extending from the rectangular-in-cross-section body 163 of the post 114. The post 114 with the pin 164 at the outer end thereof extends through the partially annular slot 108 in the cap 26 to a position where the pin 164 extends across a portion of the transverse slot 50 in the cap 26. The pin 164 at the end of the post 114 is adapted to engage one or the other of two spaced apart lugs or ears 166, 168 of the shuttle 30 for causing the shuttle 30 to be located in a particular position thereof relative to the cap 26 upon rotation of the cap 26, as will be described in greater detail hereinafter.

As shown in FIGS. 2A and 2B, the shuttle 30 has a unique configuration with a rounded head portion 170 and a body portion 172. The spaced apart rearwardly ears or lugs 166, 168 extend rearwardly from the body portion 172.

The rounded head portion 170 of the shuttle 30 is received between hills 59 and 60 so as to float in the notch 61 therebetween in or on the end or pivot wall 58 of the slot 50 on rotation of the cap 26. In this respect, as shown in FIG. 5, the rounded head portion 170 will bear against the hill 60.

The body portion 172 of the shuttle 30 has two shoulders 174, 176 on either side of the rounded head portion 170.

When the shuttle is moved to the foam position shown in FIG. 11, the rounded head portion 170 will also engage the hill 60 to position the shuttle 30 in a desired location as will be described in greater detail hereinafter.

When the shuttle 30 is in a spray position shown in FIG. 9, the rounded head portion 170 is located between the hills 59 and 60 as shoWn in FIG. 9. When the cap 26 is moved from the spray position to the stop position, the shuttle 30 will be in the position of the shuttle shown in FIG. 11 but the cap 26 and the inner edge 58 of the slot 50 will be in the position of the edge 58 shown in FIG. 5. This alternating position of the shuttle 30 in a stop position of the cap 26 is not shown in the drawings.

Referring again to FIGS. 2A and 2B, the body portion 172 of the shuttle 30, in addition to having a rounded head portion 170 and two shoulders 174 and 176 as well as two rearwardly extending ears or lugs 166 and 168 also has the arcuate or bean shaped slot 160 therethrough which extends from a back side 178 of the shuttle 30 to a front side 180 of the shuttle 30 as shown in FIGS. 2A and 2B. One lobe 181 of the bean shaped slot 160 extends through the body portion 172 to a spoke formation 184 formed at the front side 180 of the shuttle 30 in the area of the lobe space 181 of the arcuate bean shaped slot 160. A second lobe space 182 extends completely through the body portion 172. The spoke formation 184 includes spokes 186 which extend from a hub 188 to the edges of the lobe space 181 and to an arcuate rim which extends across the bean shaped slot 160 to provide a rim for the spokes 186 that extend thereto. The spokes 186 extend inwardly to the hub 188 which is conical in shape as best shown in FIGS. 6, 9 and 12. The cone shaped hub 188 extends to an apex rearwardly as shown in FIGS. 6, 9 and 12. When this conically shaped hub 188 is positioned in front of the orifice 62, as shown in FIG. 12, liquid exiting the orifice 62 will be deflected outwardly through the spaces between the spokes 186 and against the threaded surface 68 of the foaming cylinder 66 defining the foam generating chamber 69.

A flat base of the hub 188 and flat side of the spokes 186 are shown in FIG. 2A on the front side 180 of the body portion 172 of the shuttle 30. Also shown is guide notch or chute 190 that extends from the edge of the lobe space 182 of the bean shaped slot 160 toward the shoulder 174. This arcuate chute 190 is adapted to be positioned behind the wedge shaped slot 90 when the nozzle assembly 22 is in the foam position shown in FIG. 12.

The back side of the spokes 146 can taper to an edge so as to present an inverted V shaped profile to the liquid impinging thereon. In other words, the spokes preferably have a triangle shaped cross-section.

Figure 8:
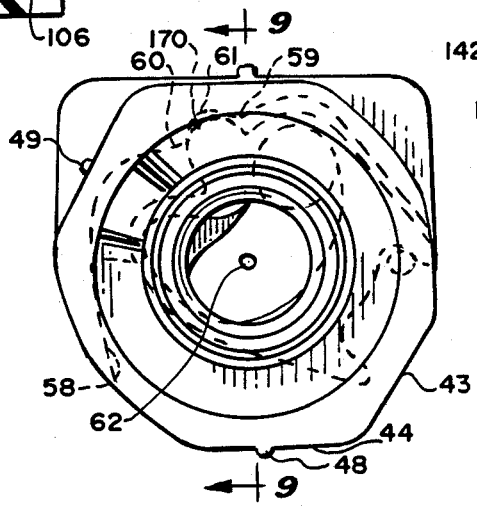
FIG. 8 is a front plan view of the nozzle assembly similar to the view in FIG. 6 but with the cap rotated 45° clockwise relative to the bushing.

In the operation of the nozzle assembly 22, assuming that the cap 26 had been rotated from the spray position shown in FIG. 8 to the stop position in FIG. 5, it will be apparent that the middle portion of the bean shaped slot 160 and the through portion 182 of the slot 160 in the area of the lobe space 182 is positioned behind the foam generating chamber 69 and the ear or lugs 166 engage the pin 164. In the stop position of the cap 26 and shuttle 30 it is to be understood, of course, that the shuttle 30 could be in the position shown in FIG. 8 with the edge 58 of the slot 50 in the position shown in FIG. 5. In either case, however, neither of the pair of slots 81, 82 or 91, 92 will be in registry with the side slots 151, 152 in the boss 132 of the bushing 28 as shown in FIG. 7. As a result, liquid cannot flow from the tubular portion 116 of the bushing 28 to either part of slots 81, 82 or 91, 92 in the short cylinder 80 of the cap 26 and no liquid can be ejected from the nozzle assembly 22.

Figure 10:
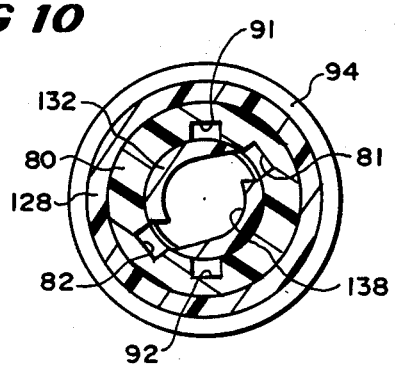
FIG. 10 is a sectional view similar to the view shown in FIG. 7 and is taken along line 10—10 of FIG. 9.

Then, when the cap 26 is rotated to the spray position shown in FIG. 8, the lobe space 182 of the bean shaped slot 160 in the shuttle 30 is caused to be positioned directly behind the foam generating chamber 69 as a result of the ear or lug 168 of the shuttle 30 engaging the pin 164 and the head portion 170 being pivoted about the notch 61 between the hills 59 and 60. In this position, the side slots 151, 152 and the tangential slots 141, 142 in the boss 132 of the bushing 28 are in registry with the pair of slots 81, 82 in the short cylinder 80 of the cap 26 such that liquid can flow through the tubular portion 116, through the slot 135 in the front plate portion 120, through the annular space 134 and through slots 81 and 82 to the side slots 151, 152 and then through the tangential slots 141, 142 into the cavity 138 in a swirl as shown in FIG. 10. The swirling liquid then exits through the orifice 62, through the lobe space 182 of the shuttle 30 and out through the foaming chamber 69, as shown in FIG. 9 in a spray pattern. This is the spray position of the nozzle assembly 22.

Figure 11:
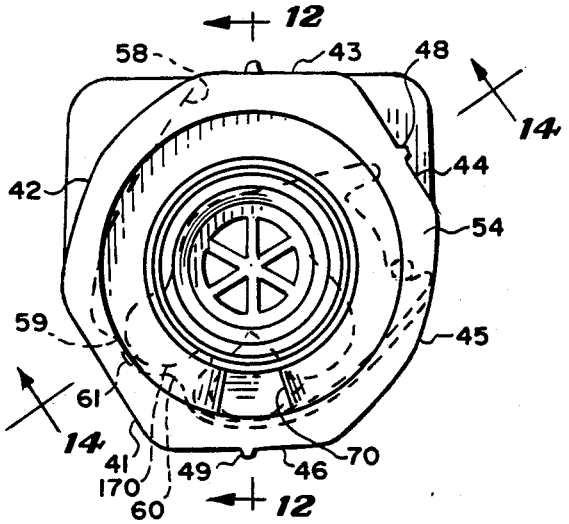
FIG. 11 is a front plan view of the nozzle assembly, similar to the views shown in FIGS. 5 and 8 but with the cap rotated 135° counterclockwise from the position shown in FIG. 8 relative to the bushing.

Then, when the nozzle assembly 22 is rotated to the foam position shown in FIG. 11, the rounded head portion 170 pivots between the hills 59 and 60. Here the shoulder 174 of the body portion 172 of the shuttle 30 rests against the hill 60 and the chute 190 is positioned directly behind the wedge shaped slot 70 in the front wall 54 of the cap 26. In this position, air can enter through the wedge shaped slot 70 in the front wall 54 of the cap 26 along the guide notch or chute 190 to the lobe space 182 of the bean shaped slot 160 and in the area around the cone shaped hub 188 and behind the spokes 186. In this area, liquid being ejected from the orifice 62 in a swirl or spray passes through the space between the spokes 146 and some liquid engages the tapered side of the cone shaped hub 188. Here the air can mix with the liquid being ejected from the orifice 62 and can enter the foaming chamber 69 from the rear side thereof and mix with sprayed liquid impinging upon the threaded inner surface 68 in the foam generating chamber 69. It will be understood that the force of the fluid ejected from the orifice 62 against the spokes 146 serves to induce air into the chute 190 and the lobe space 182 of the bean shaped slot 160 for entering into the foaming chamber 69 for mixing with the liquid spray to form foam. In this respect, the air is educed from the front of the cap 26 through the wedge shaped slot 70 in the front wall 54, the chute 190, the lobe space 182 to the lobe space 181 having the spokes 186 therein. This results in the creation of foam in the foam generating chamber 69 which is ejected from the foaming cylinder 66 upon successive actuations of the trigger 16 of the trigger sprayer 10.

Figure 13:
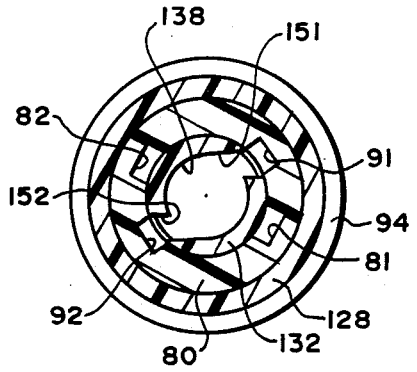
FIG. 13 is a sectional view similar to the view shown in FIGS. 7 and 10 and is taken along line 13—13 of FIG. 12.

As shown in FIGS. 13 and 14, in this foam position, liquid flows through the annular space 135, the slots 91, 92 which are in registry with the slots 141, 142, and slots 141, 142 and 151, 152 to the cavity 138 and out the orifice 62.

Also it is to be noted that the wedge shaped slot 70 of the cap 26 is located at the bottom of the cap 26 such that any foam dripping out of the foam generating chamber 69 and around the short cylinder 80 will be sucked back into the nozzle assembly 22 through the wedge shaped slot 70 in the front wall 54 of the cap 26 which is then located at the bottom of the cap 26.

From the foregoing description it will be apparent that the nozzle assembly 22 of the present invention has a number of advantages, some of which have been described above and others of which are inherent in the invention. Notably, the nozzle assembly 22 has only three pieces, the cap 26, the bushing 28 and the shuttle 30. Although each of these pieces has a number of structural formations thereon, as described above, each of these pieces can be injection molded so that once the molds are formed, each piece can be mass produced, with a minimum of cost. As a result, the spray/off/foam nozzle assembly 22 of the present invention provides a simple and very efficient means for providing both spray and foam.

It will also be apparent from the foregoing description that modifications can be made to the nozzle assembly of the present invention Without departing from the teachings thereof. In this respect, a foam generating chamber 209 within a foaming cylinder 210 can be generally conical in shape and have a serrated surface 212 as shown in FIG. 2B. This facilitates not only a better spray pattern by reason of the conical shape of the foam generating chamber 209 but also facilitates the generation of foam since the spray, as directed by the cone shaped hub 188, will better engage the serrated surface 212 of the foam generating chamber 209 for creating foam.

Also the back edge 58 of the slot 50 can be repositioned clockwise such that a portion of the hub 60 extends across part of and behind the wedge shaped slot 70 for accurate locating of the chute 190 by reason of engagement of the shoulder 174 against the hill 60.

Accordingly, the scope of the invention is only to be limited as necessitated by the accompanying claims.

We claim:

1. A nozzle assembly for mounting to a trigger sprayer having a body with a front portion and a passage therein and a trigger mounted thereto, said nozzle assembly comprising: a cap, a bushing for mounting to a front portion of a body of a trigger sprayer in communication with a passage in the trigger sprayer; said bushing having first passage means for communicating the passage in the body with said cap and said cap having second passage means for communicating with said first passage means in said bushing, said cap being mounted to and on said bushing and being rotatable on said bushing between three positions, they being a stop position where the first passage means does not communicate with the second passage means, a spray position where said first passage means is in communication with said second passage means and a foam generating position where said first passage means is in communication with said second passage means, said respective first and second passage means of said bushing and said cap being arranged to communicate with each other in the rotated spray position and in the rotated foam generating position of the nozzle assembly, and foam generating means movably mounted within said cap and arranged to be moved into communication with said second passage means when said cap has been rotated to said foam generating position for generating foam on actuation of a trigger of the trigger sprayer to which the nozzle assembly is mounted.

2. The nozzle assembly of claim 1 wherein said cap has a longitudinal axis about which it is rotated and a transverse slot in said cap extending transversely of said longitudinal axis, and said foam generating means includes a shuttle which is received in said slot and which is movable upon rotation of said cap between a spray position and a foam generating position.

3. The nozzle assembly of claim 2 wherein said shuttle has a spoke formation including at least two spokes and a slot therein, a part of said slot extends through the shuttle and part of said slot extends to said spoke formation through which liquid is sprayed and deflected by said spokes.

4. The nozzle assembly of claim 3 wherein said foam generating means includes a form chamber having a generally cylindrical wall surface in said cap extending forwardly outwardly from said cap and communication with said transverse slot so that, when said spoke formation of said shuttle is moved to a position behind said foam chamber in the foam generating position of said cap, liquid sprayed through said spoke formation is deflected by said spokes against said generally cylindrical wall surface.

5. The nozzle assembly of claim 4 wherein, when said cap and said shuttle are in the spray position, said through portion of said slot in said shuttle is positioned behind said foam chamber.

6. The nozzle assembly of claim 5 wherein said cap has a longitudinally extending slot therein which extends parallel to said longitudinal axis and arcuately about said axis and said nozzle bushing has a post which extends outwardly therefrom into said transversely arcuate, longitudinally extending slot in said cap and which is positioned to engage said shuttle upon rotation of said cap for holding said shuttle in a desired position relative to said rotated cap for establishing a foam generating position or spray position of said nozzle assembly.

7. The nozzle assembly of claim 6 wherein said shuttle, at a forward end thereof, has a detent forming a pivot point which is adapted to next in a depression in an inner wall of the cap and, at a rear end of the shuttle, said shuttle has two spaced apart rearwardly extending lugs or ears which are positioned in the cap to engage the post upon movement of the cap carrying the shuttle therewith.

8. The nozzle assembly of claim 3 wherein said shuttle has a front side and a back side and spokes of said spoke formation have on the back side of said shuttle a configuration which will deflect liquid angularly through the openings between said spokes.

9. The nozzle assembly of claim 3 wherein said shuttle has a front side and a back side and said spoke formation includes a central hub, and said hub on the back side of said shuttle has a configuration which will deflect liquid angularly and outwardly from a longitudinal axis through said hub.

10. The nozzle assembly of claim 3 wherein said generally cylindrical wall surface is an irregular surface.

11. The nozzle assembly of claim 3 wherein said shuttle has a front side and a back side and wherein said shuttle has a recess or cavity in the back side thereof behind said spoke formation.

12. The nozzle assembly of claim 3 wherein said cavity has a generally kidney bean shape.

13. The nozzle assembly of claim 4 wherein said shuttle has a front side and a back side and has a guide notch formed in the front side thereof communicating with said through portion of said slot through said shuttle, said cap has a front wall with a wall slot therethrough, and said guide notch is positioned behind said slot and in said front wall when said cap is rotated to said foam position so that air can be sucked into said transverse slot through said wall slot and guide notch.

14. The nozzle assembly of claim 13 wherein said nozzle assembly has a bottom side and said wall slot is located adjacent said bottom side of said nozzle assembly when said cap is rotated to said foam generating position.

15. The nozzle assembly of claim 1 wherein said second passage means in said cap for communicating with said passage means in said busing comprises a spray passage portion and a foam passage portion, said spray passage portion being in communication with said first passage means of said bushing when said cap is in said spray position and said foam passage portion being in communication with said first passage means of said bushing when said cap is in said foam generating position.

* * * * *

UNITED STATES PATENT AND TRADEMARK OFFICE

CERTIFICATE OF CORRECTION

PATENT NO. : 4,890,792

DATED : January 2, 1990

INVENTOR(S) : Douglas S. Martin and Joseph W.J. Maas

It is certified that error appears in the above-identified patent and that said Letters Patent is hereby corrected as shown below:

Column 2, line 56, "Fig. 3" should be --Fig. 3 is--.

Column 5, line 26, "look" should be --lock--;

line 45, "11,142" should be --141,142--.

Column 6, line 48, "shoWn" should be --shown--.

Column 8, line 58, "Without" should be --without--.

Column 9, line 53, "communication" should be --communicating--.

Column 10, line 14, "next" should be --nest--;

line 55, "busing" should be --bushing--.

Signed and Sealed this

Ninth Day of March, 1993

*Attest:*

STEPHEN G. KUNIN

*Attesting Officer*

*Acting Commissioner of Patents and Trademarks*